US006987492B1

(12) United States Patent
Buchanan et al.

(10) Patent No.: US 6,987,492 B1
(45) Date of Patent: Jan. 17, 2006

(54) TETRAHEDRAL POSITIONER FOR AN ANTENNA

(75) Inventors: Alan McLean Buchanan, Sandy, UT (US); Pamela Sue Silcox, Toelle, UT (US)

(73) Assignee: L-3 Communications Corporation, New York, NY (US)

( * ) Notice: Subject to any disclaimer, the term of this patent is extended or adjusted under 35 U.S.C. 154(b) by 7 days.

(21) Appl. No.: 10/891,900

(22) Filed: Jul. 14, 2004

(51) Int. Cl.
*H01Q 3/02* (2006.01)

(52) U.S. Cl. ..... 343/882; 343/766

(58) Field of Classification Search ..... 343/757, 343/765, 766, 832, 840, 880, 882
See application file for complete search history.

(56) References Cited

U.S. PATENT DOCUMENTS

| | | | | | |
|---|---|---|---|---|---|
| 3,383,081 | A | | 5/1968 | Guttenberg | 248/346 |
| 4,156,241 | A | | 5/1979 | Mobley et al. | 342/352 |
| 4,360,182 | A | * | 11/1982 | Titus | 248/371 |
| 4,602,259 | A | * | 7/1986 | Shepard | 342/359 |
| 4,937,587 | A | | 6/1990 | Tsuda | 343/765 |
| 5,025,262 | A | | 6/1991 | Abdelrazik et al. | 343/705 |
| 5,469,182 | A | * | 11/1995 | Chaffee | 343/882 |
| 5,619,215 | A | | 4/1997 | Sydor | 343/766 |
| 5,875,685 | A | | 3/1999 | Storaasli | 74/490.1 |
| 6,366,240 | B1 | | 4/2002 | Timothy et al. | 342/417 |
| 6,459,410 | B1 | | 10/2002 | Pulsipher et al. | 342/428 |
| 6,459,411 | B2 | | 10/2002 | Frazier et al. | 342/455 |
| 6,646,598 | B1 | | 11/2003 | Timothy et al. | 342/359 |

OTHER PUBLICATIONS

Internet page, www.apcominc.com/randtron/endfarry.htm, Mar. 12, 2004, 1 page.

* cited by examiner

*Primary Examiner*—Shih-Chao Chen
(74) *Attorney, Agent, or Firm*—Harrington & Smith, LLP

(57) ABSTRACT

In accordance with an embodiment of the invention, an antenna assembly is disclosed. The assembly comprises an antenna; and a positioner capable of assuming a tetrahedral shape connected to the antenna and mounted to an antenna mount pedestal. The positioner comprises a substantially flat base portion; and a triangular shaped antenna face bracket rotatably coupled to the base portion. The positioner further comprises an extendable, linear stiffening member connected between the base portion and the triangular shaped antenna face bracket; and an actuator to rotate the triangular shaped face bracket of the antenna assembly and form the positioner in combination with the linear stiffening member, triangular shaped antenna face bracket and base portion.

40 Claims, 12 Drawing Sheets

TETRAHEDRAL POSITIONER FOR AN ANTENNA

GOVERNMENT RIGHTS

The present invention was made with support under Contract No. F19628-02-C-0048 awarded by the Government. The Government has certain rights in this invention.

BACKGROUND OF THE INVENTION

1. Field of the Invention

The present invention relates to an antenna assembly, more particularly, to a positioner for an antenna.

2. Background Information

FIGS. 1–2 show an example of an airborne and ground based antenna pointing mechanism, respectively. Antenna mounting systems or positioners for antennas typically utilize X-Y type mounts or have azimuth and elevation rotational axes. Positioners employing gimbal mounts have been used to position antennas, lasers and other devices. As a target moves relative to a gimbal-mounted antenna, the antenna moves to maintain the target within the beam of the antenna. The effectiveness of the device is dependent upon the precision and stability of the positioning.

Antennas are typically isolated as much as possible from their host, such as a high-altitude airplane, to avoid pointing errors. Position feedback is often provided to a position control system to effect precise positioning. Cables providing electronic signal interchange and power transfer between the antenna platform and aircraft are also typically routed in a manner to minimize the forces exerted upon the platform.

Aircraft antenna mounting devices or positioners are often complex and bulky. Considerations, such as the aerodynamic requirements, space limitations and operational requirements of modern aircrafts create difficulties in the design of effective, light weight and accurate positioners for use with antenna structures, particularly airborne antennas.

Accordingly, there is a desire to provide a light weight and accurate positioner for an antenna. There is also a desire to provide an antenna assembly for airborne usage, particularly for use during aircraft operation. The present invention satisfies these needs and others.

SUMMARY OF THE INVENTION

In accordance with one aspect of the present invention, an antenna assembly is disclosed. The assembly comprises an antenna; and a positioner capable of assuming a tetrahedral shape connected to the antenna and mounted to an antenna mount pedestal. The positioner comprises a substantially flat base portion; and a triangular shaped antenna face bracket rotatably coupled to the base portion. The positioner further comprises an extendable, linear stiffening member connected between the base portion and the triangular shaped antenna face bracket; and an actuator to rotate the triangular shaped face bracket of the antenna assembly and form the positioner in combination with the linear stiffening member, triangular shaped antenna face bracket and base portion.

In accordance with another aspect of the present invention, a tetrahedral-shaped positioner for an antenna is disclosed. The positioner comprises a substantially flat base portion; and a triangular shaped antenna face bracket rotatably coupled to the base portion. The positioner further comprises an extendable, linear stiffening member connected between the base portion and the triangular shaped antenna face bracket; and an actuator to rotate the triangular shaped face bracket of the antenna assembly and form the positioner in combination with the linear stiffening member, triangular shaped antenna face bracket and base portion.

In accordance with a further aspect of the invention, a method of positioning an antenna is disclosed. The method comprises providing the afore-described antenna assembly and securing the antenna mount pedestal on a substrate selected from the group consisting of an airborne based device and a ground based device. The method further comprises controlling the linear member to position the antenna.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
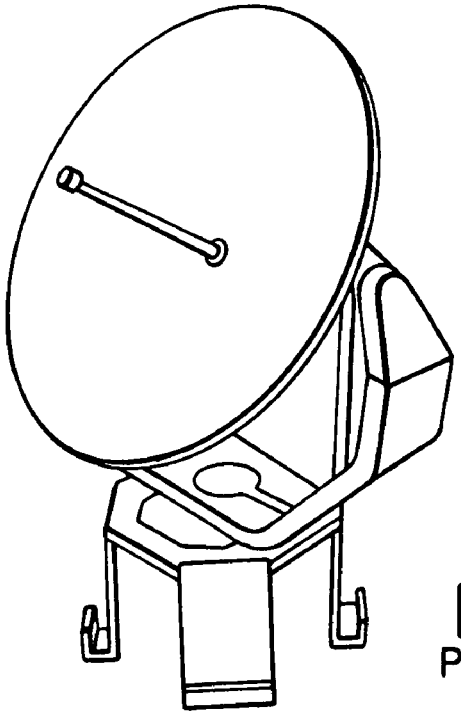
FIG. 1 PRIOR ART
FIG. 1 is a perspective view of an airborne antenna pointing mechanism (prior art)
Figure 2:
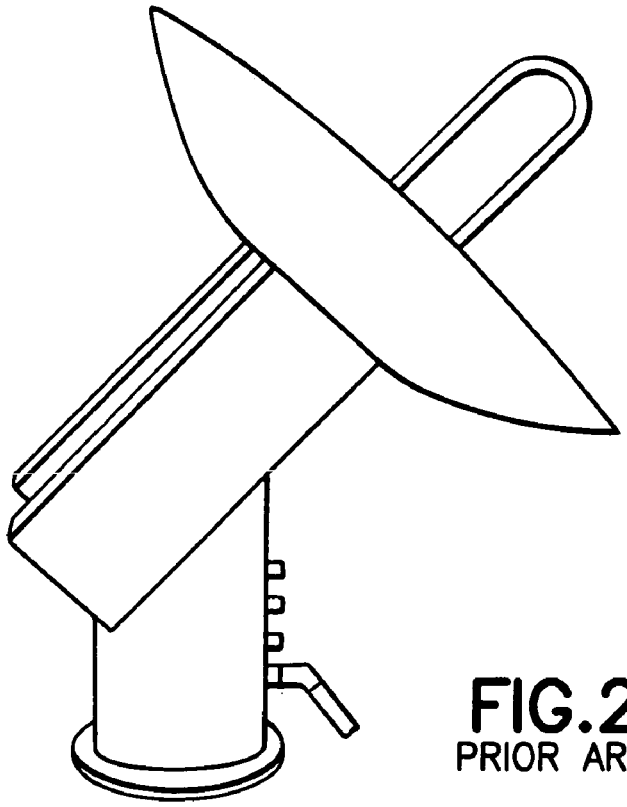
FIG. 2 PRIOR ART
FIG. 2 is a perspective view of a ground based antenna pointing mechanism (prior art)
Figure 3:
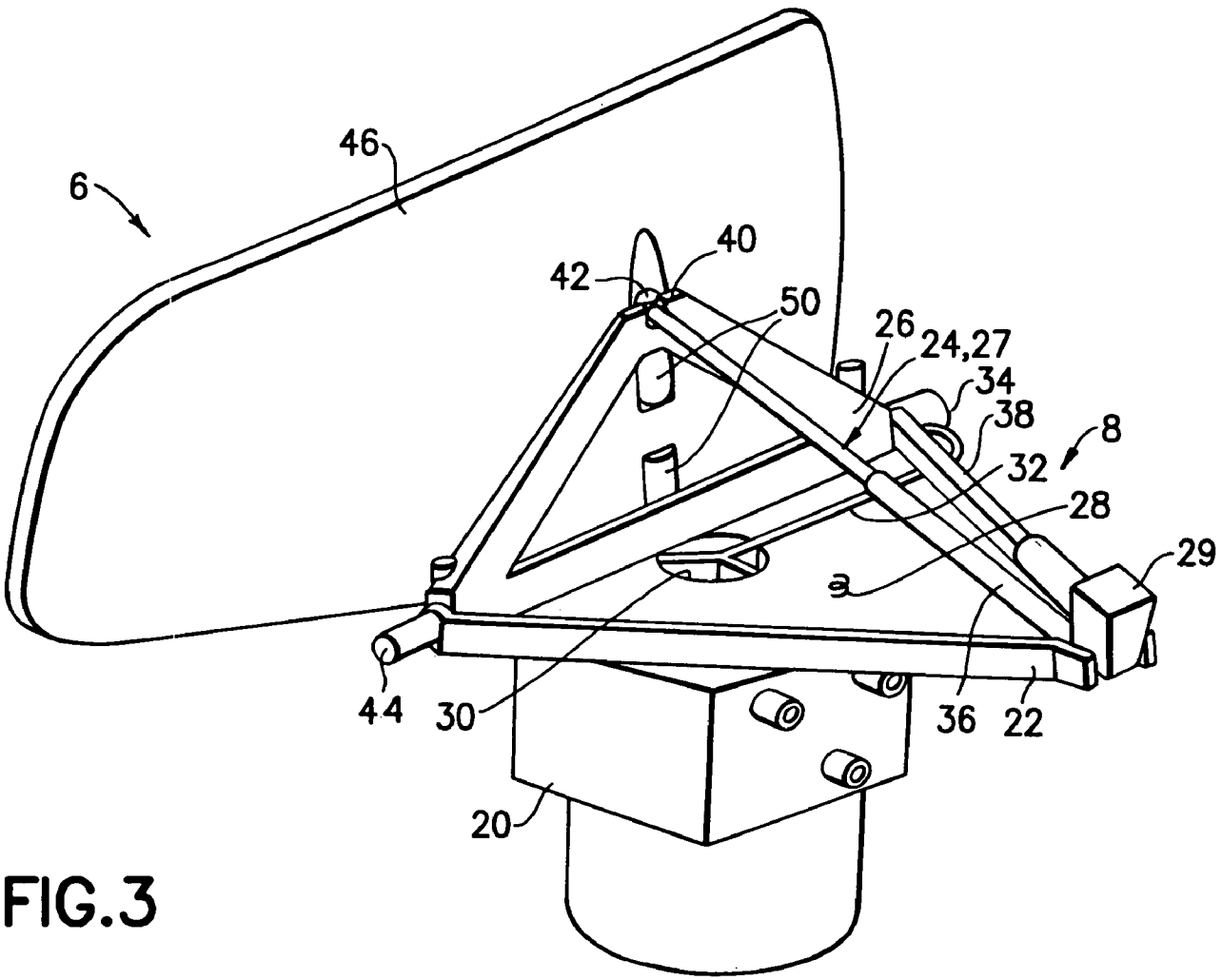
FIG. 3 is a perspective view of an antenna assembly, including a tetrahedral positioner for a low-profile, three degree of freedom directional antenna, in accordance with an embodiment of the invention.

Referring to FIG. 3, there is shown a perspective view of an antenna assembly 6, incorporating features of the present invention. The antenna assembly 6 advantageously includes a positioner 8 capable of assuming a tetrahedral shape, as shown in this figure. Although the present invention will be described with reference to the embodiment shown in the drawings, it should be understood that the present invention can be embodied in many alternate forms of embodiments. In addition, any suitable size, shape or type of elements or materials could be used.

An embodiment of the invention is directed to a tetrahedral positioner, which may be used to mount an antenna such as a directional antenna on an aircraft or other suitable vehicle. New features of embodiments of the invention include a tetrahedral shaped positioner, as well as a linear actuator as one leg of a space-frame antenna support structure to minimize height and weight. A tapered anti-detent spring may also be used beyond zenith to mitigate potential mechanical latch-up.

Another feature of embodiments of the invention is that servo design is simplified due to the use of a non-overriding linear actuator. This allows a space frame structural member to act as an active element without requiring a power-consuming brake or heavy counterweight. The tetrahedral space-frame design is preferably triangulated in three dimensions for a high stiffness to weight ratio. High specific stiffness is important for passively obtaining high pointing accuracy while being subjected to aircraft vibration and maneuvers.

Figure 6:
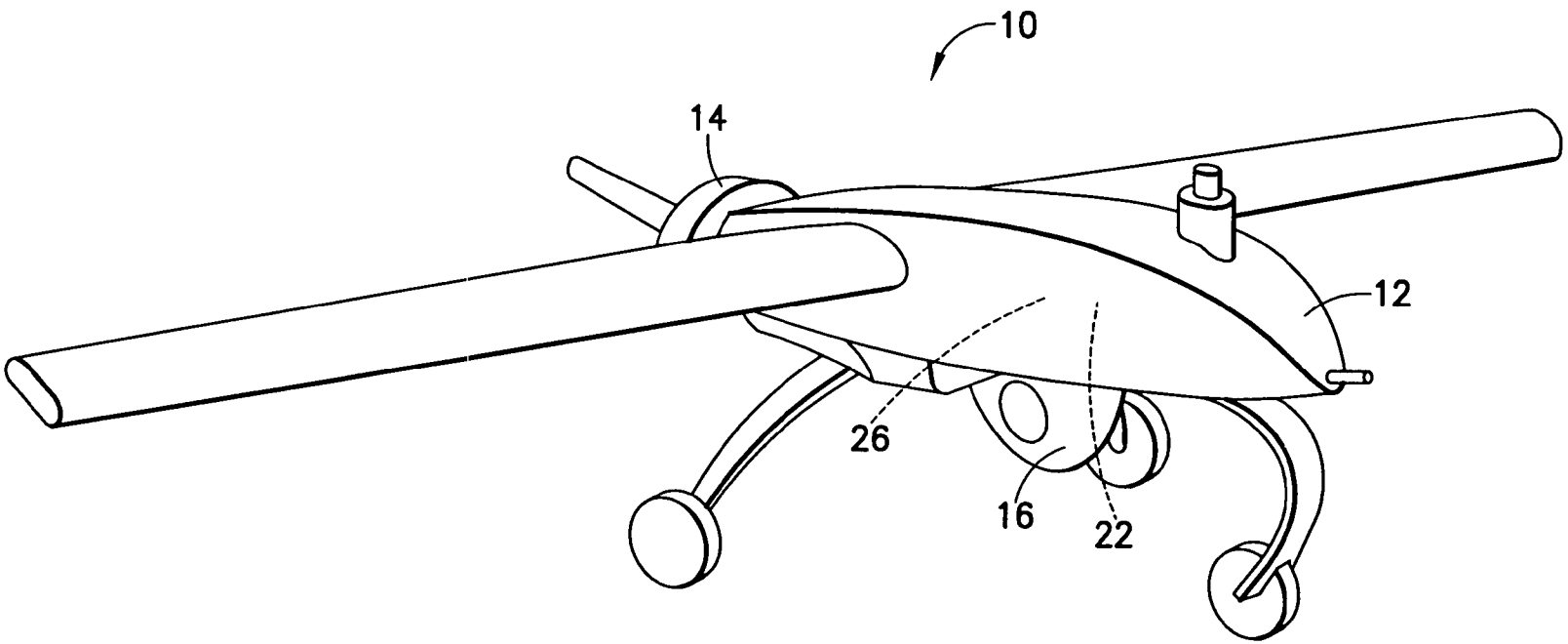
FIG. 6 is a perspective view of an aircraft upon which the antenna assembly of FIGS. 3–5 may be mounted.
Figure 7:
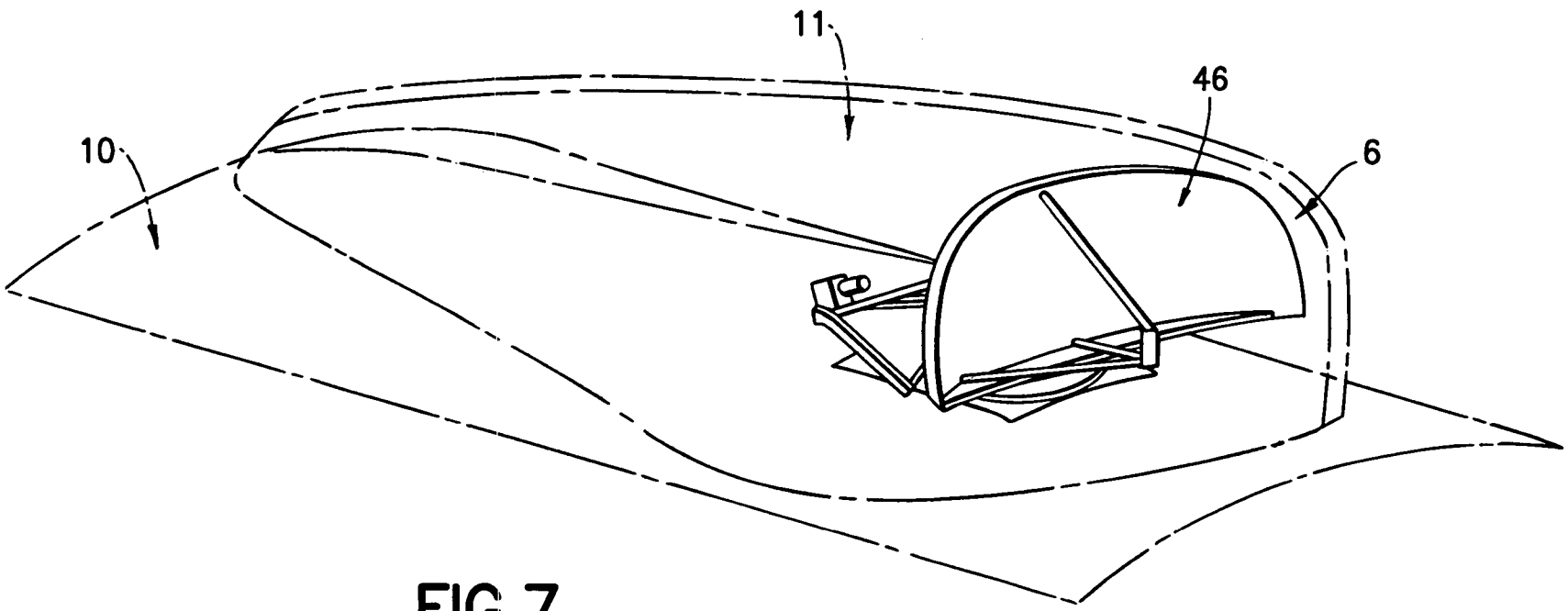
FIG. 7 is a perspective view of an antenna assembly inside a randome, in accordance with an embodiment of the invention.

In the embodiment shown in FIGS. 3–5 and 7–12, the positioner 8 can be mounted to an aircraft 10 or other suitable device, such as a land or ocean based vehicle including automobiles and ships. Examples of aircraft 10 include manned vehicles, as well as an unmanned aerial vehicle (UAV). An aircraft 10 in the form of a UAV is show in FIG. 6 generally comprising an air frame 12, a drive 14 and a viewing unit 16. The antenna assembly 6 of FIGS. 3–5 may be conventionally mounted to the aircraft 10 by bolting the base portion to a provided flange on the fuselage. As shown in FIG. 7, the antenna assembly 6 may advantageously fit within an aircraft radome 11 of any suitable size and shape. Advantageously, the antenna assembly 6 may be employed in any suitable type of device.

The air frame of the aircraft 10 may be a fixed wing type of air frame. However, features of the present invention could alternatively be used in a non-fixed wing aircraft or other suitable vehicles or devices. The drive 14, in the embodiment shown in FIG. 6, comprises a motor and a propeller. However, in alternate embodiments, any suitable type of drive could be used, such as a turbine engine. The viewing unit 16 includes an optical video camera, but could alternatively or additionally comprise an infrared video camera or any other suitable type of viewing device. The antenna assembly 6 may be used to allow remote control of the aircraft and transmission of signals from the viewing unit 16 back to a remote viewing area.

Referring to FIGS. 3–5 and 9–12, the antenna assembly 6 generally comprises a positioner 8, an antenna 18 and an antenna mount pedestal 20 adapted to be mounted on aircraft 10 or other suitable vehicle. The antenna mount pedestal 20 preferably comprises an azimuth drive and an azimuth motor. The pedestal 20 may also be a direct drive or a gear. This device may include a position feedback mechanism that controls the positioning of the antenna 18. Alternatively, the antenna mount pedestal 20 may comprise a conventional X-Y pitch arrangement suitable for aircraft radar systems. In a preferred embodiment, the antenna mount pedestal 20 is rigid in design with respect to the platform and does not provide external rotation, but includes internal rotating components. Alternatively, the pedestal 20 may include an external rotational feature.

Figure 13:
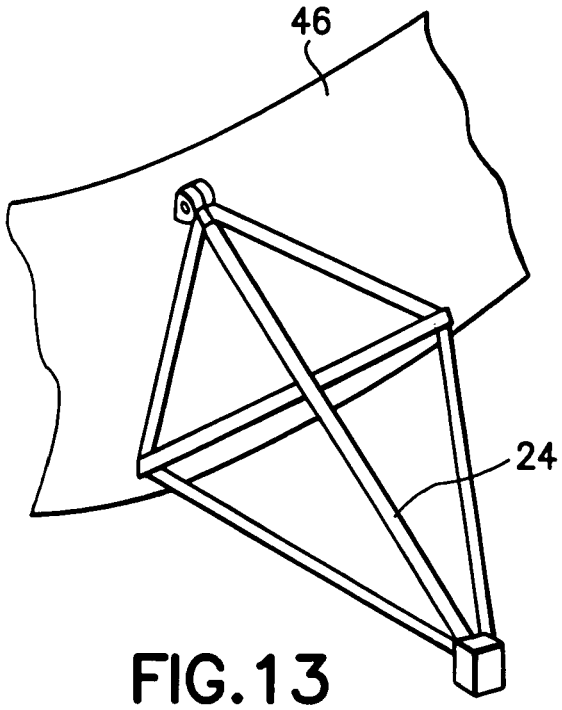
FIG. 13 shows a simplified view of the tetrahedral positioner of FIG. 3.

Secured to the antenna mount pedestal 20 is the positioner 8, as shown in FIGS. 3–5 and 9–12. The positioner 8 preferably includes a rotatable three legged rigid support structure capable of forming the tetrahedral shape. FIG. 13 illustrates a simplified view of this tetrahedral shape.

In the embodiment shown in FIGS. 3–5 and 9–12, positioner 8 includes a substantially flat base portion 22, a triangular shaped antenna face bracket 26 rotatably coupled to the base portion 22; an extendable, linear stiffening member 24 connected between the base portion 22 and the triangular shaped antenna face bracket 26; and an actuator 29 connected to the member 24. Preferably, each leg is spaced approximately equidistant from each other.

Base portion 22 is preferably triangular in shape and advantageously provides a light weight structure. Other suitable shapes, such as circular, square and rectangular shapes, among others, may also be employed for base portion 22.

Figure 8:
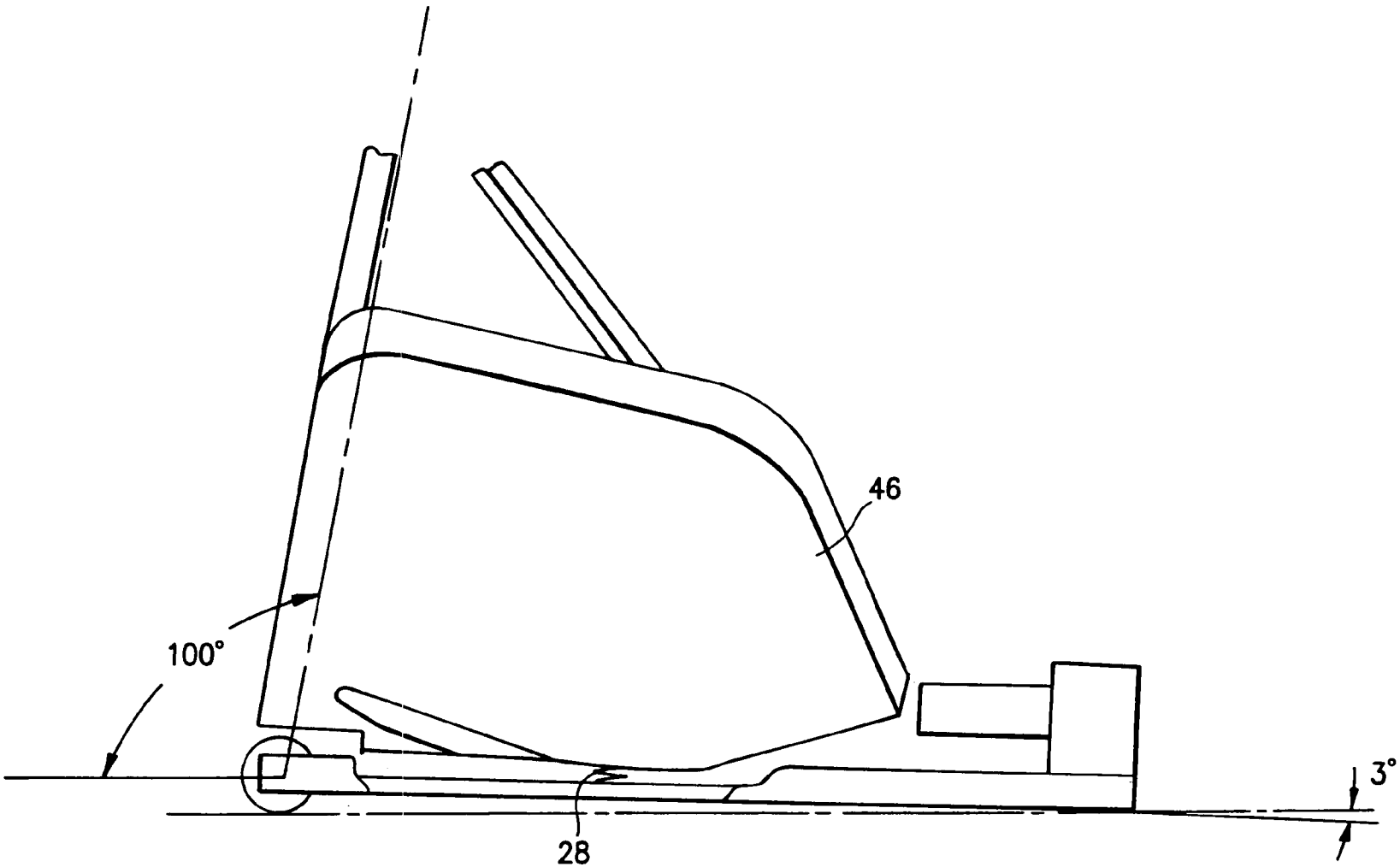
FIG. 8 is a side view of an antenna assembly showing an anti-lock spring, in accordance with an embodiment of the invention.

Base portion 22 also preferably includes an anti-detent or anti-lock spring 28, as best seen in FIG. 3. For example, during operation the antenna 18 may rotate or fold to approach a closed position. To prevent locking, spring 28 can be employed on base portion 22 as a force to offset the inertia of the folding antenna 18 thereby advantageously preventing lock up. As also shown in FIG. 8 and in accordance with an embodiment of the invention, a full 100° elevation range may be obtained by the anti-lock feature, including spring 28.

Base portion 22 also preferably includes an opening or aperture 30 through which screws may bolt to the pedestal 20 for securing base portion 22 to the pedestal 20. A waveguide transmit channel 32 may extend from aperture 30 to a conventional rotary joint connection 34 enabling transmission of RF energy through the azimuth drive unit. In other embodiments, the RF energy could be conveyed through a coaxial cable or optical energy could be used. The optical drive could be mounted to reflector 46 of the antenna assembly 6 to minimize losses. Dual RF/optical systems can also benefit from the teachings of this invention. Moreover, the reflector 46 could be used with laser devices and thus the present invention is not limited to use with RF antennas.

Figure 4:
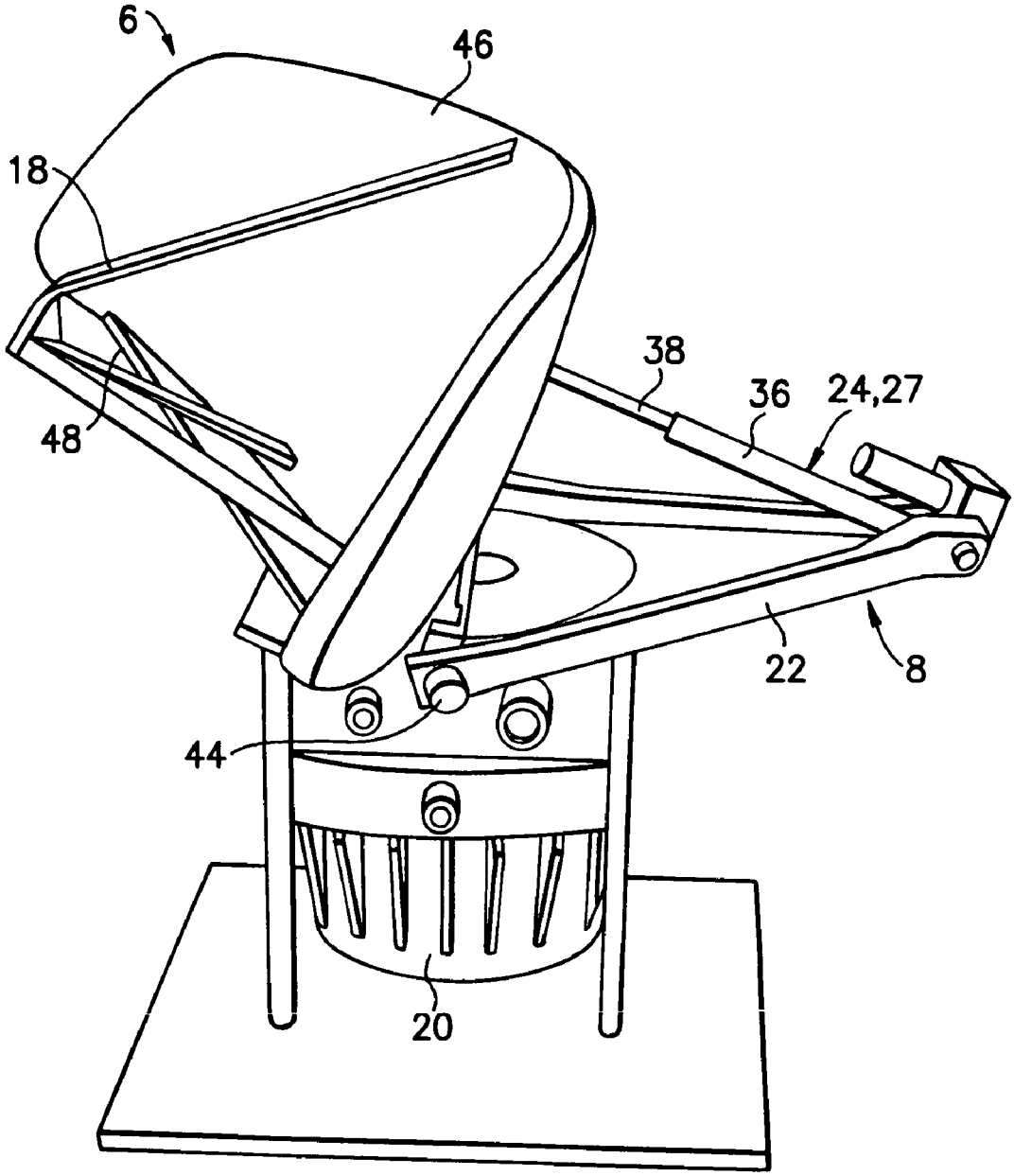
FIG. 4 is a side view of the antenna assembly of FIG. 3.
Figure 5:
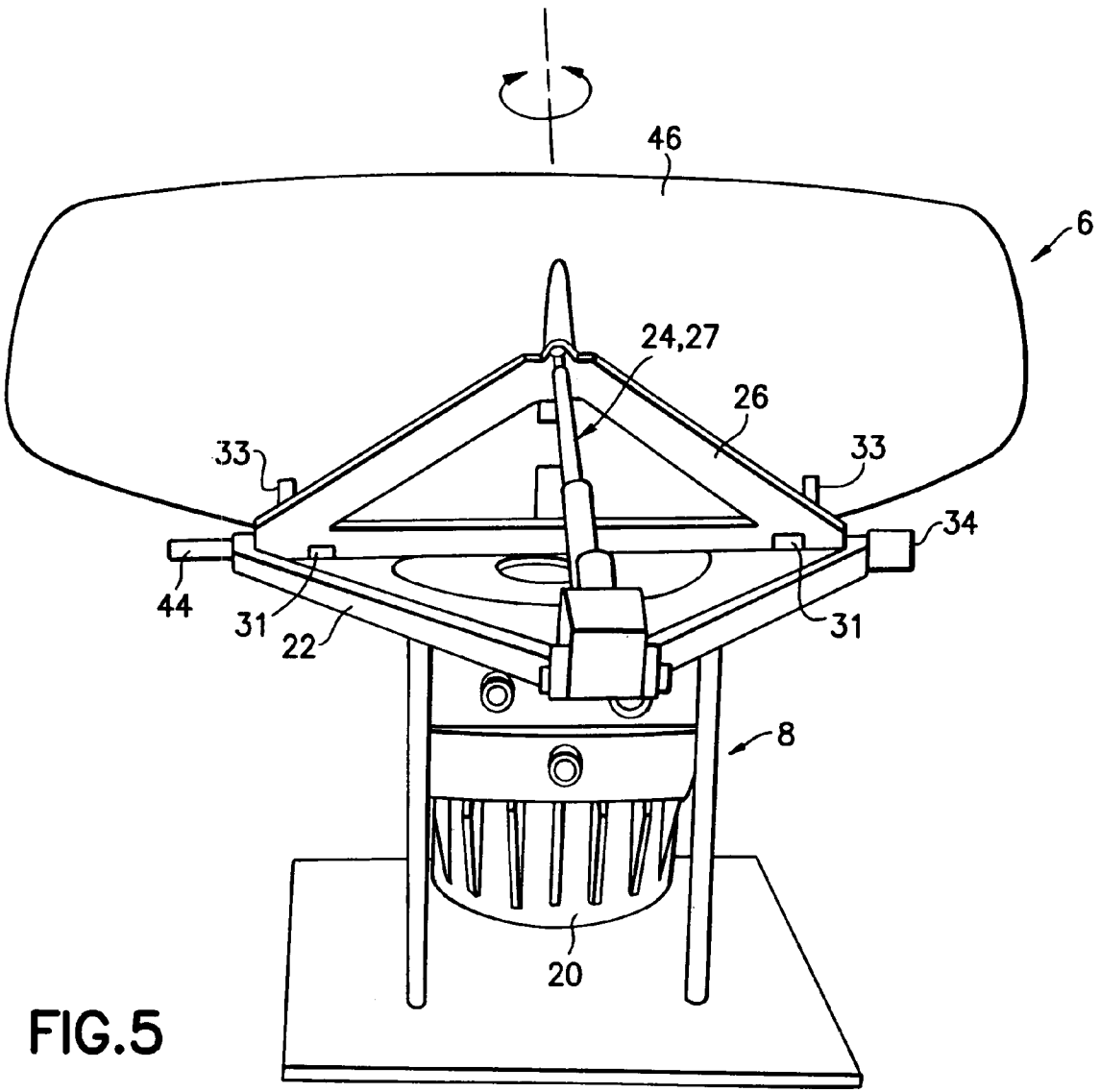
FIG. 5 is a rear view of the antenna assembly of FIG. 3.

Linear stiffening member 24 is coupled to the base portion 22, as shown in FIGS. 3–5, and provides the center leg of the positioner 8. Preferably, member 24 is a linear actuator 27, as shown in the figures, advantageously providing an anti-back drive capability. For example, in conventional antenna designs, a brake or high gear ratio is required. Such features are not required in embodiments of the invention with use of linear actuator 27 as part of the positioner 8. For example, linear actuator 27 may includes a sleeve portion 36 with an internal rotating ball screw or drive mechanism attached to a brushless DC actuator. Alternatively, AC or brush type linear actuators may also be employed. The linear actuator 27 also includes a sliding portion 38, which can feed into and out of the stationary actuator assembly. Advantageously, the linear actuator 27 is of a stiff construction and is accurate in its positioning of antenna 18. For instance, the linear actuator 27 may extend and retract to properly position antenna 18. Linear actuator 27 may also turn the power to the antenna 16 to an on/off position as it is controlled by a drive control motor in the afore-described pedestal 20. As shown in the FIGS. 3–5, the linear actuator 27 preferably includes an actuator or motor 29 located at one end of the linear actuator 27. In this case, the linear actuator 27 may also function as a dampening mechanism.

In some embodiments, the linear stiffening member 24 may simply be a linear stiffener without an actuator or motor 29. Thus, member 24 may provide a supporting center structure for the positioner 8 with or without a linear sensing device located at one end of the member 24 in place of the actuator or motor 29. In these embodiments, the actuator or motor 29 may be located on other parts of the positioner 8 to provide the controlling action, as described in further detail below.

The antenna face bracket 26 connected to linear member 24 is preferably triangular in shape, as shown in FIGS. 3–5 and advantageously provides a light weight structure, as well as a high specific stiffness (stiffness to weight ratio).

Figure 14:
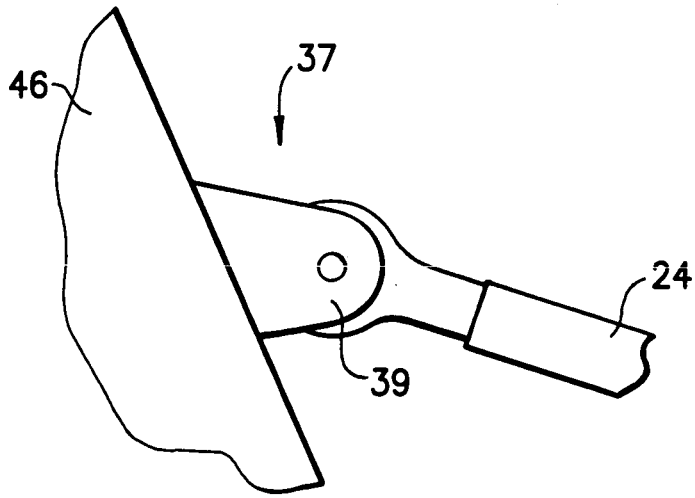
FIG. 14 shows the connector of FIG. 3 in greater detail.

The base of the triangular antenna face bracket 26 is preferably mounted to the base portion 22 of the positioner 8 by hinges 31, shown in FIG. 5. The top portion 40 of the triangular antenna face bracket 26 provides an aperture or opening 42 for linear member 24, as shown in FIG. 3. As in the case of the other legs of the positioner 8, the triangular antenna face bracket 26 may be of any suitable width, height and length. Preferably, as best seen in FIG. 5, the height of the triangular antenna face bracket 26 measured from its top portion 40 to its base is less than about ten inches and preferably less than about six inches. The triangular antenna face bracket 26 also preferably includes hinges 31, as shown in FIG. 3, located in an outward position to enhance the stiffening and stability capabilities of the positioner 8. A connector 37 may also be provided at the top portion 40. This connector 37 is shown in further detail in FIG. 14 and comprises a bracket 39 for rotatably connecting the reflector 46 to the linear member 24.

An actuator or motor 29 may be located at one or both ends of the triangular antenna face bracket 26 adjacent the base portion 22. Similarly, a cross-elevation actuator could be employed at the top portion 40 of the triangular antenna face bracket 26.

Figure 9:
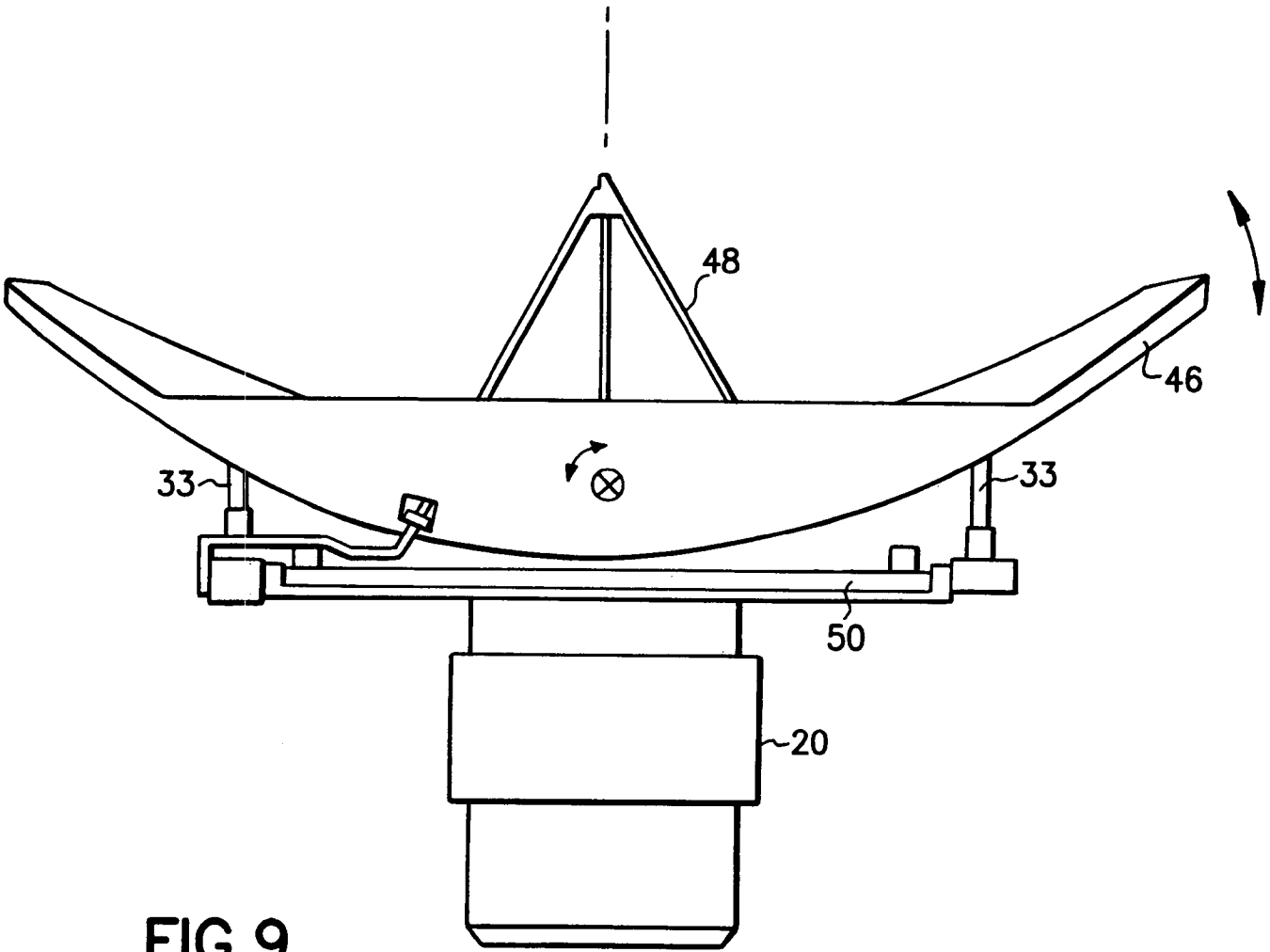
FIG. 9 is a side view of an antenna assembly showing a cross-elevation axis, in accordance with an embodiment of the invention.
Figure 10:
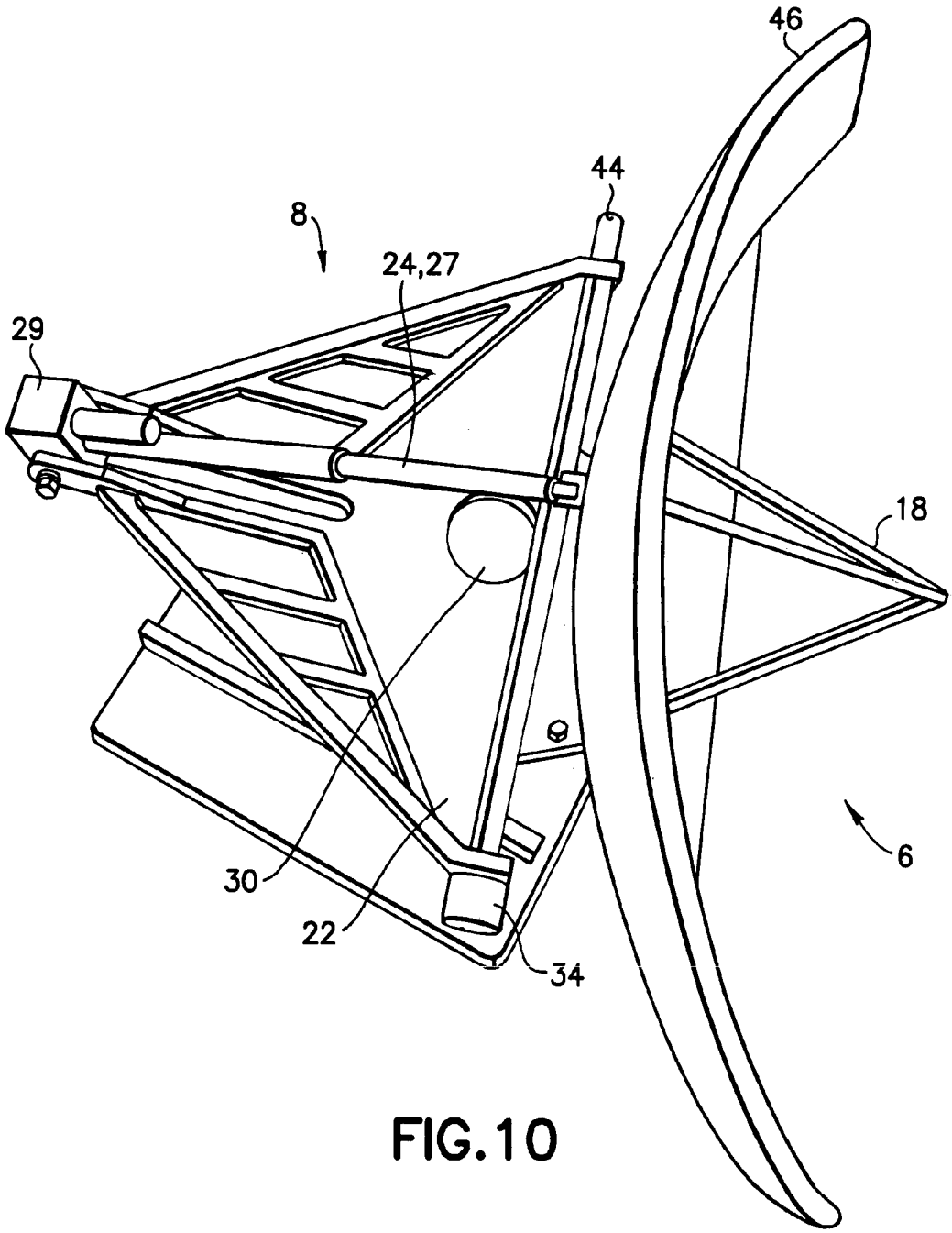
FIG. 10 is an overhead view of FIG. 3.
Figure 11:
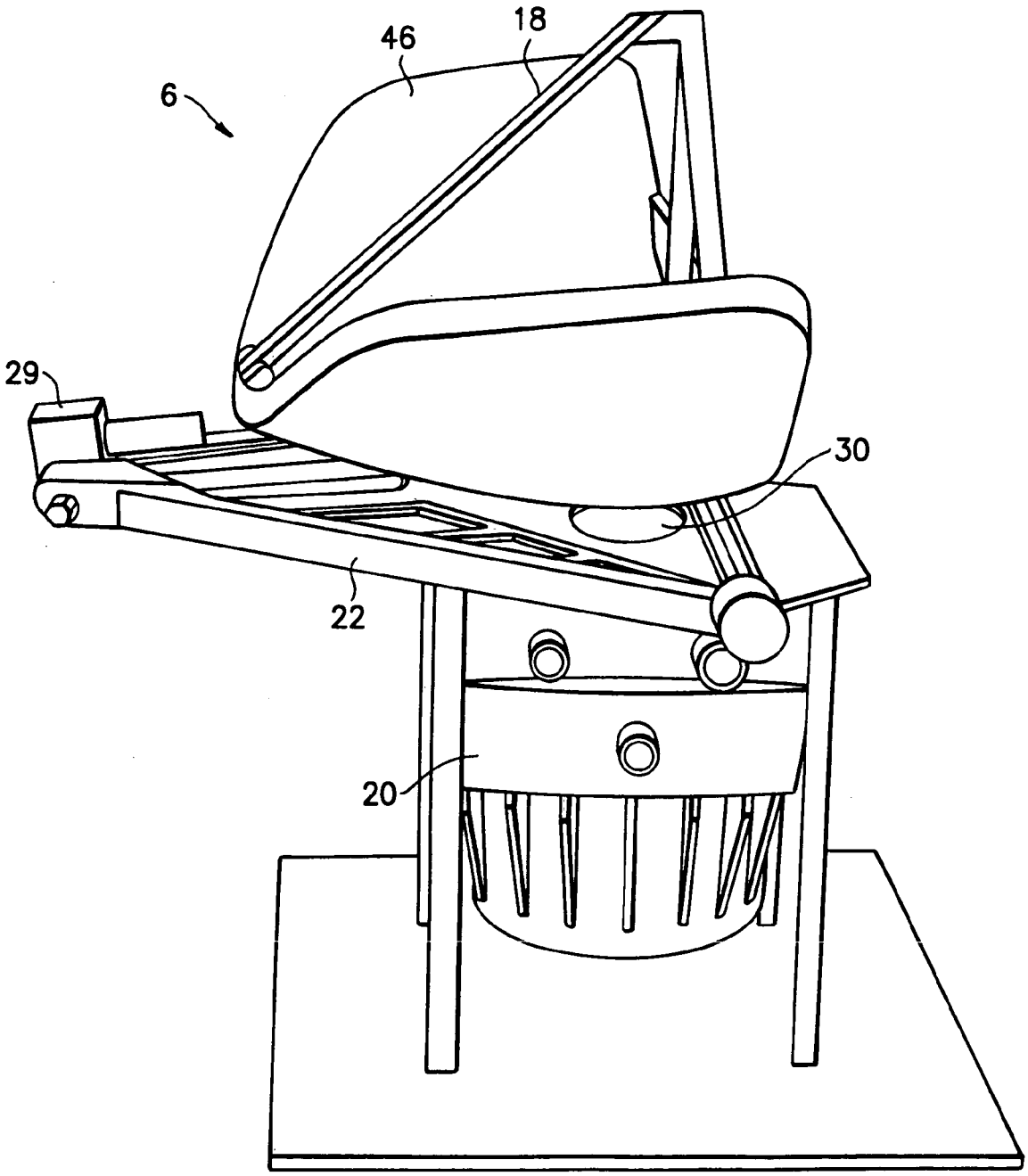
FIG. 11 shows the antenna assembly of FIG. 3 with the reflector in a folded position.
Figure 12:
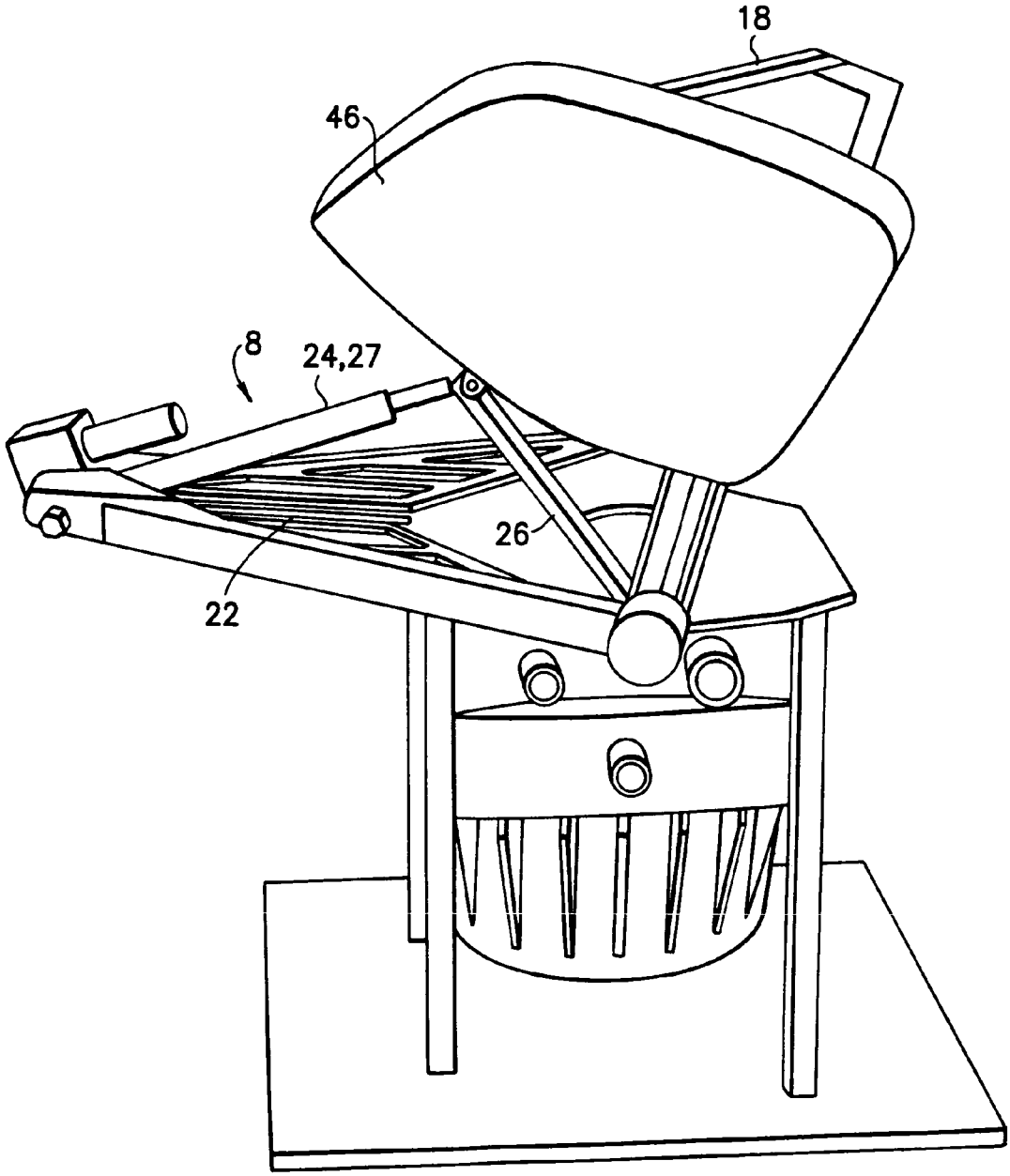
FIG. 12 shows the antenna assembly of FIG. 3 with the reflector in a partially folded position.

Cross-elevational bands 33, as shown in FIGS. 5 and 9, may also be employed to move the reflector 46 about the cross-elevational axis. Advantageously, at high pointing angles, the bands 33 provide extra ability for accurate pointing. However, if the reflector 46 is in a fully folded position, the bands 33 may not need to be employed for control. Similarly, if a cross-elevation actuator is employed at the top portion 40 of the bracket 26, the bands 33 may not need to be employed.

At an intersection of the triangular antenna face bracket 26 and the base portion 22 of the positioner 8 is typically an angular position detector 44, such as a three or four wire device or optical encoder, providing position feedback, as shown in FIG. 3. Other suitable detectors include resolvers, synchros, magnetic encoders and potentiometers, angular sensing and angular rotation sensing devices. Preferably, this device is a cylindrical, elevation multi-turn resolver.

The triangular antenna face bracket 26 supports the antenna 18. More particularly, the bracket 26 is secured to one side of reflector 46 of the antenna 18. The reflector 46 may be of any suitable shape. For example, the reflector 46 may be of a dish shape, as shown in FIGS. 3–5, or may be rectangular or circular in construction, among other suitable shapes. The reflector 46 may also be of any suitable size and is preferably less than about 12 inches in height, as shown in FIG. 5. Similarly, the reflector 46 may be made out of any suitable material including, for example, high strength polymeric, composite and metallic materials.

The antenna 18 also preferably includes a tripartite antenna structure 48, as shown in FIG. 4. However, other suitable antenna constructions may also be employed. The antenna 18 is also preferably a directional antenna although other types of antennas, such as ommi-directional, are also suitable. The antenna assembly 6 is also preferably constructed such that during level flight the antenna 18 is substantially parallel to the surface of the earth.

The antenna assembly 6 may also advantageously include a cross-elevation axis or three-axis pedestal 50, as shown in FIG. 9, about which the reflector 46 rotates. Advantageously, a cross-elevation of about +/−7 degrees may be achieved in accordance with embodiments of the invention. Alternatively, the cross-elevation axis may include a two-axis pedestal.

Advantageously, embodiments of the invention also provide a low cost intrinsically stiff cross-elevation over elevation over azimuth gimbal system for low-profile antenna pointing, which overcomes design challenges. For example, each axis presents a unique design challenge, such as high performance servo (azimuth), size and package constraints (elevation) and clearance at extreme positions (cross-elevation).

Thus, an advantage of embodiments of the invention includes the unique EL/X-EL/Azimuth design. For example, advantages of the azimuth axis design include the following: direct drive in azimuth, which is very responsive, accurate and eliminates gearing backlash; preloaded crossed-roller bearings, which provide positioning accuracy, stiffness and robustness, although taper-loaded bearing may also be employed; and slip-ring for 360° continuous rotation, including redundant Au contacts and double seals. Advantages of the elevation and cross-elevation design include its low cost potential and simple design construction.

Another advantage of embodiments of the present invention includes providing a light weight and accurate positioner for an antenna, particularly an airborne antenna. The total weight of the positioner 8 may vary depending on, for example, the size of the randome employed, aircraft or other considerations. The components of the positioner 8 may be made out of any suitable material, including conventional high strength polymeric, metallic and composite materials. For example, materials such as stainless steel, carbon fiber, etc. may be employed.

It should be understood that the foregoing descriptions are only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An antenna assembly comprising:

an antenna; and a positioner capable of assuming a tetrahedral shape connected to the antenna and mounted to an antenna mount pedestal, wherein the positioner comprises:

a substantially flat base portion;

a triangular shaped antenna face bracket rotatably coupled to the base portion;

an extendable, linear stiffening member connected between the base portion and the triangular shaped antenna face bracket; and an actuator to rotate the triangular shaped face bracket of the antenna assembly and form the positioner in combination with the linear stiffening member, triangular shaped antenna face bracket and base portion.

2. The antenna assembly of claim 1, wherein the assembly is adapted to be mounted to an aircraft.

3. The antenna assembly of claim 1, wherein the assembly is adapted to be mounted to a ground based device.

4. The antenna assembly of claim 2, wherein the assembly is adapted to fit within an aircraft radome.

5. The antenna assembly of claim 1, wherein the antenna mount pedestal comprises at least one component selected from the group consisting of an azimuth drive, an azimuth motor, a direct drive and a gear.

6. The antenna assembly of claim 5, wherein the antenna mount pedestal comprises an angular position detector.

7. The antenna assembly of claim 1, wherein the positioner includes a rotatable three legged rigid support structure forming a tetrahedral shape.

8. The antenna assembly of claim 7, wherein each leg is spaced at approximately equidistant from each other.

9. The antenna assembly of claim 7, wherein the base portion is triangular in shape.

10. The antenna assembly of claim 1, wherein the base portion includes an anti-lock spring.

11. The antenna assembly of claim 1, wherein a linear actuator is a center leg of the positioner and an actuator or motor is located at one end of the linear actuator.

12. The antenna assembly of claim 11, wherein the linear actuator comprises a sliding portion and a sleeve portion with an internal rotating ball screw or drive attached to a brushless DC actuator.

13. The antenna assembly of claim 11, wherein the linear actuator comprises an AC or brush type linear actuator.

14. The antenna assembly of claim 11, wherein the linear actuator is of a stiff construction, which extends and retracts to position the antenna.

15. The antenna assembly of claim 1, wherein a top portion of the triangular shaped antenna face bracket provides an aperture for the linear member.

16. The antenna assembly of claim 1, wherein height of the triangular shaped antenna face bracket as measured from its top portion to its base portion is less than about ten inches.

17. The antenna assembly of claim 16, wherein the height is less than about six inches.

18. The antenna assembly of claim 1, wherein the antenna comprises a reflector.

19. The antenna assembly of claim 18, wherein the reflector is less than about twelve inches in height.

20. The antenna assembly of claim 18, wherein the reflector has a shape selected from the group consisting of a dish shape, a rectangular shape and a circular shape.

21. The antenna assembly of claim 1, wherein the antenna is selected from the group consisting of a directional antenna and an omni-directional antenna.

22. The antenna assembly of claim 18 further comprising a three-axis pedestal or two-axis pedestal about which the reflector rotates.

23. The antenna assembly of claim 1, comprising a gimbal system for antenna pointing including a cross-elevation axis, an azimuth axis and an elevation axis.

24. The antenna assembly of claim 1, comprising an actuator or motor connected between the triangular shaped antenna face bracket and the base portion.

25. The antenna assembly of claim 1, comprising a cross-elevational actuator.

26. The antenna assembly of claim 1, further comprising a connector to connect a reflector of the antenna to the positioner.

27. The antenna assembly further comprising bands to position a reflector of the antenna.

28. A tetrahedral-shaped positioner for an antenna comprising:

a substantially flat base portion;

a triangular shaped antenna face bracket rotatably coupled to the base portion;

an extendable, linear stiffening member connected between the base portion and the triangular shaped antenna face bracket; and an actuator to rotate the triangular shaped face bracket of the antenna assembly and form the positioner in combination with the linear stiffening member, triangular shaped antenna face bracket and base portion.

29. The tetrahedral-shaped positioner of claim 28 comprising a rotatable three legged rigid support structure forming a tetrahedral shape.

30. The tetrahedral-shaped positioner of claim 29, wherein each leg is spaced at approximately equidistant from each other.

31. The tetrahedral-shaped positioner of claim 30, wherein the base portion is triangular in shape.

32. The tetrahedral-shaped positioner of claim 31, wherein the base portion includes an anti-lock spring.

33. The tetrahedral-shaped positioner of claim 28, wherein a linear actuator is a center leg of the tetrahedral-shaped positioner.

34. The tetrahedral-shaped positioner of claim 33, wherein the linear actuator is of a stiff construction, which extends and retracts to position the antenna.

35. The tetrahedral-shaped positioner of claim 34, wherein a top portion of the triangular-shaped antenna face bracket provides an aperture for the linear actuator.

36. The tetrahedral-shaped positioner of claim 28, comprising an actuator or motor connected between the triangular shaped antenna face bracket and the base portion.

37. The tetrahedral-shaped positioner of claim 28, wherein the antenna is an airborne antenna.

38. A method of positioning an antenna comprising:

providing the antenna assembly of claim 1; and securing the antenna mount pedestal on a substrate selected from the group consisting of an airborne based device and a ground based device; and controlling the linear member to position the antenna.

39. The method of claim 38, wherein the antenna is a directional antenna or an omni-directional antenna.

40. The method of claim 38, wherein the linear member is a linear actuator.

* * * * *

UNITED STATES PATENT AND TRADEMARK OFFICE

CERTIFICATE OF CORRECTION

PATENT NO. : 6,987,492 B1
DATED : January 17, 2006
INVENTOR(S) : Buchanan et al.

It is certified that error appears in the above-identified patent and that said Letters Patent is hereby corrected as shown below:

Column 8,
Line 1, insert -- of claim 1 -- between “assembly” and “further”.

Column 7,
Line 44, delete “assembly”.

Signed and Sealed this

Twenty-first Day of March, 2006

JON W. DUDAS
*Director of the United States Patent and Trademark Office*